US005137469A

United States Patent [19]

Carpenter et al.

[11] Patent Number: 5,137,469

[45] Date of Patent: Aug. 11, 1992

[54] HYBRID CONNECTOR FOR STANDARD COAXIAL CABLE AND OTHER WIRING SYSTEMS

[75] Inventors: Robert G. Carpenter, Saugerties; Gerald J. Hladik, Kingston; Lawrence G. Mosher, Rhinebeck; James T. Zahorsky, Saugerties, all of N.Y.

[73] Assignee: International Business Machines Corporation, Armonk, N.Y.

[21] Appl. No.: 740,374

[22] Filed: May 31, 1985

[51] Int. Cl.[5] ..... H01R 17/04

[52] U.S. Cl. ..... 439/578; 439/218

[58] Field of Search ..... 339/154–156, 339/164, 166, 168, 170, 177 R, 177 E, 17 LC; 200/51.1

[56] References Cited

U.S. PATENT DOCUMENTS

| | | | |
|---|---|---|---|
| 950,107 | 2/1910 | Larsson | 200/51.1 |
| 2,691,770 | 10/1954 | Jonaitis | 339/177 |
| 3,124,406 | 3/1964 | Cook | 339/177 R |
| 3,166,649 | 1/1965 | Frantz et al. | 339/177 |
| 3,179,912 | 4/1965 | Huber et al. | 339/177 R |
| 3,202,953 | 8/1965 | Bosworth et al. | 339/177 |
| 3,206,540 | 9/1965 | Cohen | 339/177 |
| 3,253,250 | 5/1966 | Harrison et al. | 339/177 R |
| 3,332,052 | 7/1967 | Rusinyak | 339/177 |
| 3,335,388 | 8/1967 | Karol | 339/177 R |
| 3,387,104 | 6/1968 | Friend | 200/51.1 |
| 3,450,471 | 6/1969 | Lessler | 200/51.1 |
| 3,453,376 | 7/1969 | Ziegler, Jr. et al. | 339/177 R |
| 3,792,418 | 2/1974 | Kailus | 339/177 |
| 3,949,180 | 4/1976 | Ojima et al. | 339/177 |
| 4,206,963 | 6/1980 | English et al. | 339/154 A |
| 4,307,926 | 12/1981 | Smith | 339/177 R |
| 4,397,516 | 8/1983 | Koren et al. | 339/177 R |
| 4,420,216 | 12/1983 | Montoyama et al. | 339/177 |
| 4,431,254 | 2/1984 | Cartesse | 339/177 R |
| 4,609,242 | 9/1986 | Kemppainen | 339/17 LC |
| 4,628,159 | 12/1986 | Deitch et al. | 339/177 R |

FOREIGN PATENT DOCUMENTS

| | | | |
|---|---|---|---|
| 2424644 | 12/1979 | France | 339/177 E |
| 2016216 | 1/1979 | United Kingdom | 339/154 A |

*Primary Examiner*—David L. Pirlot

*Attorney, Agent, or Firm*—Robert L. Troike; Frederick D. Poag

[57] ABSTRACT

A hybrid connector system comprising a special jack, a standard coaxial plug effective to make contact with the jack in one mode when inserted therein, and a wire pair plug operable to engage the special jack in another mode when plugged thereinto, the wire pair plug element being adaptable to, or configured especially for, use with shielded twisted pair cables, unshielded twisted pair cables, or ordinary telephone lines. The jack or socket member has first second and third concentric contact members, two of which are arranged to engage respectively, the central and shell contacts of a coaxial cable plug. The third of the contact elements of the socket member is interposed between the first and second contact elements, and the three contact elements are positioned to engage corresponding contact elements of the special plug which, when inserted into the socket completes connection to first and second ones of a wire pair and, optionally, a shield of such wire pair. Switch means are arranged to be operated between open and closed conditions by one of the kinds of plugs which the hybrid jack is designed to receive.

12 Claims, 2 Drawing Sheets

HYBRID CONNECTOR FOR STANDARD COAXIAL CABLE AND OTHER WIRING SYSTEMS

FIELD OF THE INVENTION

This invention relates to transmission line connectors and more particularly to a plug and jack system in which the jack can receive and make the correct connections to either a standard coaxial cable plug or a shielded or unshielded wire pair plug.

BACKGROUND OF THE INVENTION

Plug and socket arrangements for transmission lines have long been used in telephony, and audio equipment, as well as in high frequency transmission lines such as seen in television and data processing work station systems.

In telephony and audio equipment, plug and jack arrangement have long been known wherein the plug may be long or short and have two or three or more axially spaced conductor elements which engage complex arrangements of cantalever sprung contact elements in the jack or socket, and wherein some of these contact elements in the socket may operate to make or break connections when displaced by the plug element. In some cases the system is such that a short plug is used for one kind of apparatus, such as a microphone, and a long plug for another kind of apparatus such as a tape unit, for example, and the contact elements in the jack automatically make the appropriate connections.

For high frequency transmission systems, the transmission lines have been divided into distinct classes, such as coaxial cable, twisted pair, shielded twisted pair, and twin-x. There have been developed for each of these high frequency wiring systems particular kinds of connectors, and when an equipment is to receive either of two different kinds of cables it has been customary to provide two jacks or sockets in the equipment, each unique to the type of cabling system the plug of which it is to receive.

Thus, although various connector systems have been known, some of which accommodate different length plugs or cause internal switching action to take place as aforesaid, there has remained an unsatisfied need for a practical connector system having a jack which will receive a standard coaxial plug such as a BNC coaxial cable plug and, in the alternative, a plug for a shielded or unshielded wire pair transmission vehicle, an moreover a need for such a hybrid arrangement wherein the jack will respond automatically to make appropriate transition from unbalanced electrical scheme of the coaxial cable to a balanced system such as usually used in the wire pair arrangement.

SUMMARY OF THE INVENTION

In accordance with the invention, the foregoing and other needs are met by a hybrid connector system comprising a special jack, a standard coaxial plug effective to make contact with the jack in one mode when inserted therein, and a wire pair plug operable to engage the special jack in another mode when plugged thereinto, the wire pair plug element being adaptable to, or configured especially for, use with shielded twisted pair cables, unshielded twisted pair cables, or ordinary telephone lines.

According to one aspect of the invention the jack or socket member has first second and third concentric contact members, two of which are arranged to engage respectively, the central and shell contacts of a coaxial cable connector. The third of the contact elements of the socket member is interposed between the first and second contact elements, and the three contact elements are positioned to engage corresponding contact elements of a special plug which, when inserted into the socket completes connection to first and second ones of a wire pair and, optionally, a shield of such wire pair.

According to still another aspect of the invention, there are switch contact means arranged for operation by and upon insertion of the respective coaxial and special wire pair plugs, or one of them to be operated between open and closed conditions by and upon insertion of one or the other of the kinds of plugs which the hybrid connector is designed receive.

Accordingly, the invention includes the combination f a socket member having first, second and third concentric contact elements together with switch means operable in a given state to effect connection between the second and third elements and in another state not to effect such connection, and plug members of first and second types each proportioned to couple with said first and second contact elements but in the case of the first type class f plugs and elements there being in such first class type plug element a member having an extent axially of the plug member adapted to engage the switch means to operate the same from one state to the other, while plug members of the second type do not effect such state change.

The foregoing and other objects, advantages and aspects of the invention will be evident from this specification as a whole.

Figure 3:
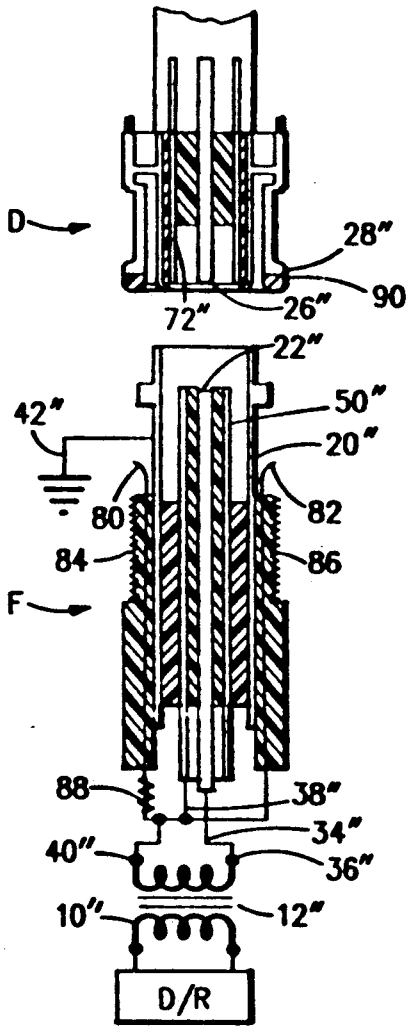
FIG. 3 shows a jack and plug pair of a second embodiment of the invention, again wherein the plug shown is for shielded or unshielded twisted pair wire and the jack can receive either that plug or a standard BNC plug.
Figure 2:
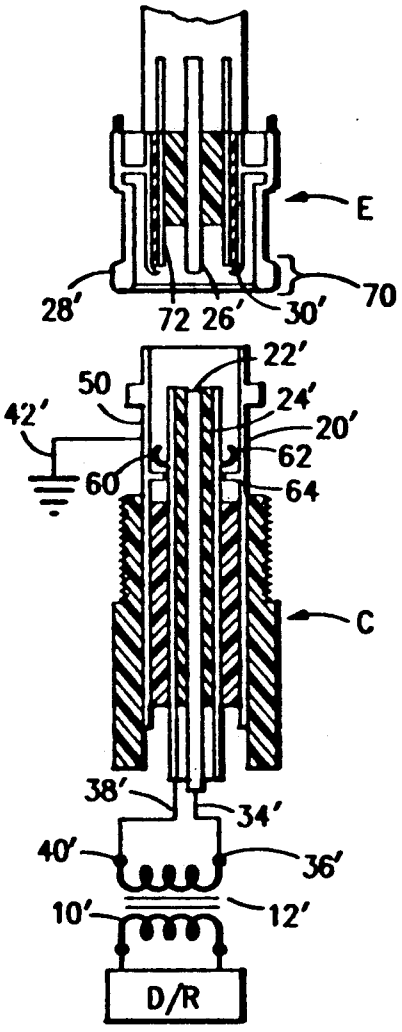
FIG. 2 shows a jack an plug pair embodying the invention, wherein the plug shown is for shielded or unshielded twisted pair wire and the jack can receive either that or the BNC plug of FIG. 1.
Figure 1:
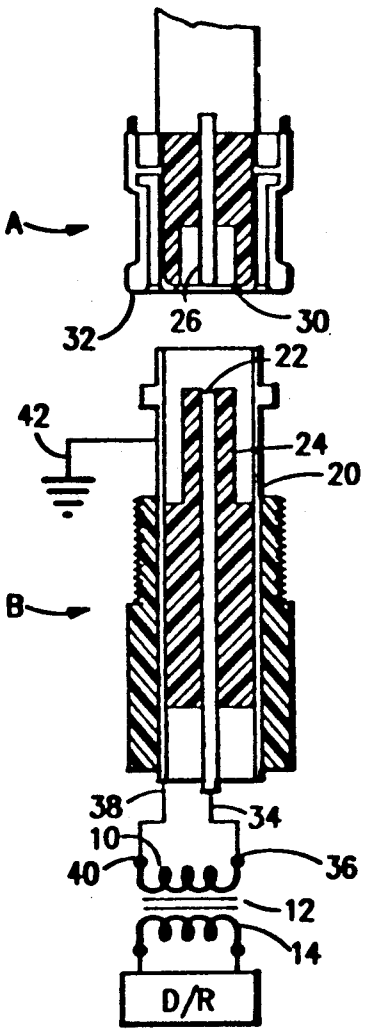
FIG. 1 shows, diagrammatically, a prior art BNC coaxial cable jack and plug pair.

In each of FIGS. 1-3 the shown partly in cross-section, and in each a schematic or typical electrical elements to be connected is included.

Figure 4:
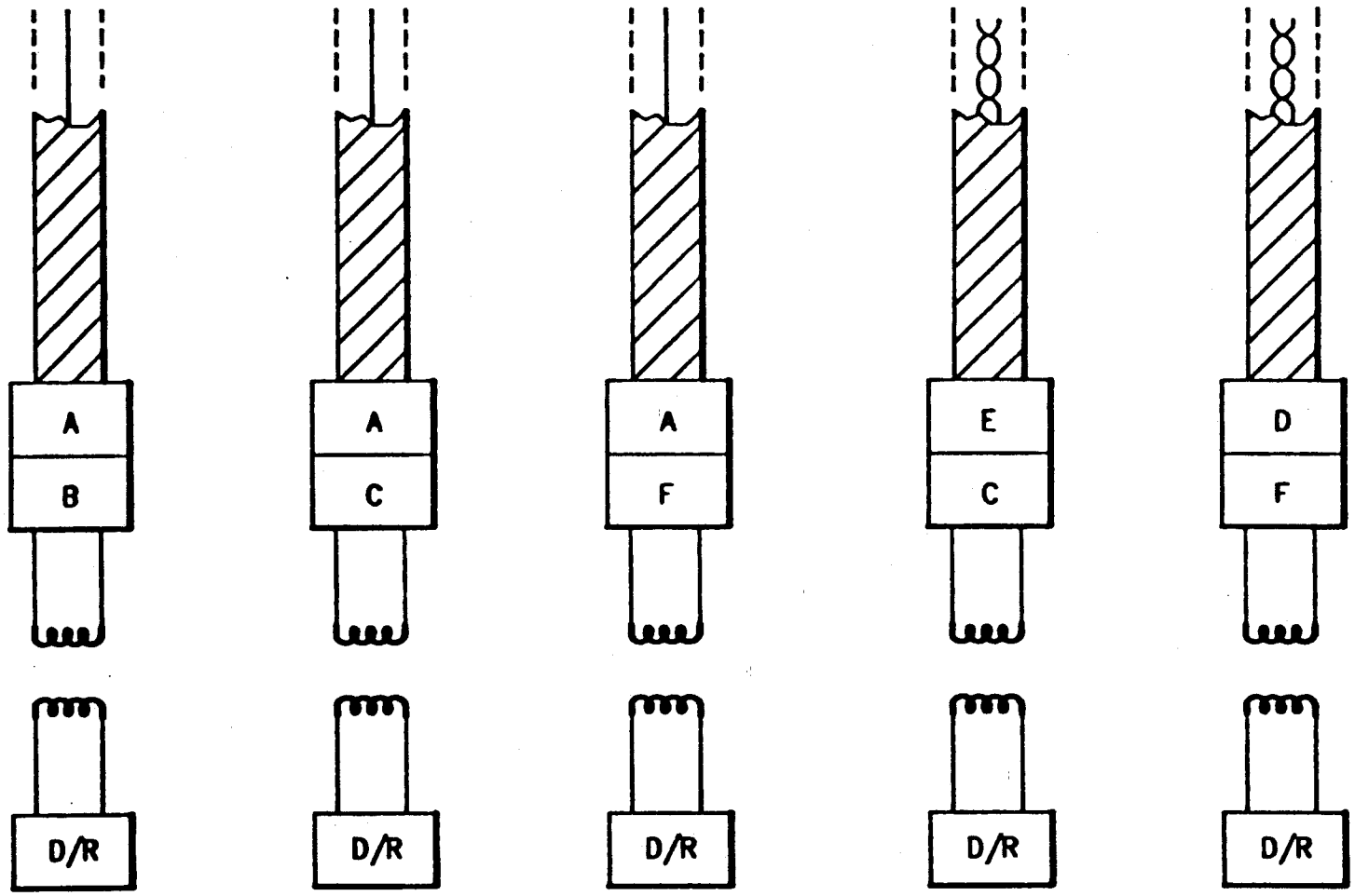

FIG. 4 shows, diagrammatically, various combinations of the plugs and jacks of FIGS. 1-3 which illustrate the utility of aspects of the invention in new and existing systems.

DETAILED DESCRIPTION

In each of the illustrated embodiments of the jack of the invention shown, the jack is connected to a winding 10 of a transformer 12, another winding of which 14 is connected to a driver/receiver D/R for receiving signals from and delivering signals to a cable connected to the jack. In the prior art example shown in FIG. 1, the BNC jack B comprises a barrel shaped contact member 20 within which is mounted a central contact element 22. Element 22 is supported in a post 24 of dielectric material and is tubular in shape to receive the central conductor 26 of a BNC plug A. The plug A includes a hollow cylinder 30 of dielectric material which fits over the post 24 and conductive coupling 32 which fits over and electrically contacts the barrel 20 of the jack when the two are mated, all as is well known in the art.

In the typical circuit shown, the central contact element 22 of the jack is connected via a conductor 34 to one terminal 36 of transformer winding 10, and the barrel element 20 is connected via conductor 38 to the other terminal 40 of that winding. Usually, the barrel 20 is grounded, as indicated at 42, and therefore, the connection to the transformer is termed "unbalanced". The plug is usually mounted on the end of a coaxial cable (FIG. 4), with the central or pin element 26 of the plug constituting an extension of the center conductor of the cable, and the coupling 32 being connected to the outer or shield conductor of the cable.

In each of the embodiments of the invention shown in FIGS. 2 and 3, a new jack and a corresponding new plug enable use in a balanced system such as is suitable for a twisted pair cable. This is accomplished by providing an additional contact element which, in the preferred embodiments of the invention, is in the form of an additional barrel, intermediate contact within but electrically isolatable from the outer barrel contact of the jack. In each case the new, twisted pair cable plug engages the center, intermediate and outer barrel elements to provide first and second connections for a twisted wire pair and, via the outer barrel, a ground connection for the cable shield, if present.

Moreover, in each of the preferred embodiments shown in FIGS. 2 and 3, the new jack of the invention can receive the standard BNC plug of FIG. 1 and has switch elements which couple the additional and outer barrel contacts of the jack so as to function in the same way as a standard BNC plug and jack combination for use in a conventional unbalanced coaxial cable system.

Referring now more particularly to FIG. 2, the jack C the invention has a conductive barrel 20' which has outer dimensions which are identical to those of the barrel 20 of FIG. 1. Mounted with the barrel 20' is a dielectric post 24', which like the post 24 of FIG. 1, carries an axial tubular contact element 22' which is identical to the tubular element 22 of FIG. 1.

In accordance with the invention the post 24' carries an additional barrel including metallic sleeve element 50, the outer diameter of which is of the same order as that of the similarly positioned post 24 of a standard BNC jack (FIG. 1), but in no event larger than the inner diameter of the hollow dielectric cylinder 30 of the standard BNC plug of FIG. 1.

The base of the sleeve element 50, FIG. 2 carries one or more contactor elements 60, 62 which are deflectable into contact with an inwardly projecting ring portion 64 carried by the outer barrel 20' but are normally clear thereof so as to constitute normally open switch means therewith.

The center contact 22' of the jack of FIG. 2 may be connected via a wire 34' to one terminal 36' of a winding 10' of a transformer 12' for coupling to a driver/-receiver D/R, similarly to the connections of FIG. 1. However, in this case the other terminal 40' of the winding 10' is connected to the intermediate barrel contact 50.

When a standard BNC plug such as the plug A of FIG. 1, is inserted in the jack C of FIG. 2 of the invention, the cylinder 30 of the plug bears against the contactor elements 60, 62, deflecting them into conductive engagement with the ring portion 64 of the outer barrel 20'. Thus, an electrical condition obtains which is identical to the plug-jack function of FIG. 1. That is, the outer barrel 20' of FIG. 2 is connected via the switch means 60, 62, 64 to the conductor 38' and terminal 40' to one end of the winding 10' and the other end of that winding is connected via the other terminal 36' and conductor 34' to the center pin of the coaxial plug.

It is a primary feature of the invention that when the plug E of the invention shown in FIG. 2 is inserted into the jack C of FIG. 2 that, instead of an unbalanced coaxial connection being made, a balanced twisted pair type hook-up is achieved. As shown in FIG. 2, the plug shown has a cylinder 30' which is generally similar to the cylinder 30 of a BNC plug of FIG. 1 with two important exceptions: it is shorter, as indicated at 70, and it carries an internal conductive sleeve 72. Because the cylinder 30' is shorter, it does not operate to close the normally open switch means 60, 62, 64, and because it carries the sleeve 72, it makes contact with the intermediate contact 50 of the jack of the invention shown in FIG. 2.

Accordingly contact is made from the plug sleeve contact 72 to the jack intermediate or additional barrel 50. At the same time, the center pin contact 26' engages conductively the axial sleeve contact 22' of the jack and thus an electrical connection is made via wire 34' to terminal 36' of winding 10'. Since the intermediate barrel 50 is isolated from the grounded outer barrel 20', the connection to the winding 10' can be a balanced one without change of the driver/receiver. Moreover, the connection from the outer coupling 28' of the plug to the outer barrel 20' is identical to that of those parts of a BNC connector system (such as one of FIG. 1). Therefore, the outer ground shield of the twisted pair cable, if such shield is provided, is terminated to ground via the jack barrel 20' as indicated at 42'.

FIG. 3 shows an alternate embodiment of the plug and jack combination of the invention. In this configuration, the switch means 80, 82 are located externally of the jack outer barrel 20" and have separate logical functions. The jack F structure is otherwise like that of FIG. 2, and similar parts are given similar numbers, except that they are distinguished by a double prime, (") for example the outer barrel of the jack is numbered 20" and the inner or intermediate barrel is numbered 50" (50 having been a new number if FIG. 2, the drawings have no 50').

Externally of the barrel shaped contact element 20" are the pair of spring contact elements 80, 82 insulated from the barrel 20" as indicated at 84, 86. Contact element 80 is connected by a resistor or other suitable impedance 88 to one terminal 40" of winding 10" of transformer 12". Terminal 40" of the transformer winding 10" is also connected to the second outer spring contact 82 and also to the intermediate barrel contact 50". The outer barrel shaped contact 20" is connected to ground as indicated at 42" and is dimensioned to be the same as the usual outer cylindrical contact of a BNC coaxial cable jack.

When a standard BNC plug A as shown in FIG. 1 is connected into the jack F of FIG. 3, the outer barrel of the BNC plug A engages over the contact barrel 20", of the jack F and is locked thereon by means of the screw grooves of the usual BNC configuration. Moreover, the outer barrel of the BNC connector A bears against both contact elements 80 and 82, thereby connecting those elements 80, 82 to the outer conductor of the coaxial cable connected to the BNC plug. As of result, the terminal 40" of the transformer is connected to the outer shell of the BNC via contact 82 and the other transformer terminal 36" is connected to the center conductor of the BNC plug via the center contact 22" of the jack and conductor 34". In addition, terminal 40" is connected to the outer shell of the BNC plug via contact 80 and impedance 88. This allows impedance matching and also provides a point at which a signal can be developed, that, is a signal across impedance 88, which can be utilized for control purposes which form no part of the present invention.

A special plug D in accordance with the invention is provided as shown in FIG. 3 for use with a shielded twisted pair cable. When the plug is engaged on the outer contact 20" of the jack F, a different circuit configuration results. The plug outer shell 28" is configured to function like the outer shell of a BNC plug as aforedescribed except that it does not contact the outer spring terminals 80, 82. This can be accomplished by making at least the end portion 90 of the plug shell 28" of non-conductive material. Like plug E of FIG. 2, the plug D of FIG. 3 has an extra cylindrical shaped contact 72" which slides over and makes contact with cylindrical shaped intermediate contact 50" of the jack, and this provides the terminal for one wire of a twisted wire pair of the cable connected to the plug. The other wire of the twisted pair is connected to a pin 26" of the plug which engages the central conductor contact 22" of the jack. Accordingly, one twisted pair conductor is connected via 26" to contact 22" and thus to terminal 36" of the transformer while the other twisted pair wire is connected via 72" and 50" to the other terminal 40" of the transformer, and neither contact 80 or 82 is electrically engaged. If the twisted pair cable is shielded, at least part of the element 28" is made of metal and provides a contact to ground at 42" via the outer barrel 20" of the jack. It will be appreciated that, if desired, one of the switch elements 60 or 62 of FIG. 2 could operate isolated from the intermediate barrel 50 and connected similarly to element 80 of FIG. 3.

FIG. 4 shows the various ways in which standard BNC plugs A can be used with a standard BNC jack B or the jack C of FIG. 2 or the jack F of FIG. 3 to provide coaxial cable connections. Similarly, that figure shows the plug E of FIG. 2, coupled with the jack C of that figure and the plug D of FIG. 3 coupled with the jack F of FIG. 3 to accommodate wire pair (such as shielded or unshielded twisted wire pairs) systems.

For illustrative purposes, the driver/receiver is shown transformer coupled to facilitate balanced or unbalanced operation. It will be understood that this would not be needed in all cases, especially where the driver/receiver is of the type that sense whether barrel connection 38, 38' or 38" is grounded or not and automatically switches between unbalanced and balanced operations.

In summary, the foregoing examples illustrate ways in which a fundamental principle of the invention can be carried into effect. That principle is that a hybrid jack can be provided that will mate with a BNC plug as if it were a BNC jack and thus provide a coaxial type unbalanced circuit connection, and that the same hybrid jack can mate with a special plug designed for it to provide a twisted pair type balanced circuit connection, the hybrid jack having a third contact for this purpose and switch means to connect that third contact alone or the outer BNC—fitting part of the jack in circuit with an output terminal in response to a conductive difference or length difference in the hybrid plug as compared to the BNC plug, which difference co-acts with the hybrid jack to make or break a circuit connection.

What is claimed is:

1. A cable connector system comprising:

a hybrid jack having a center sleeve and outer barrel of a coaxial configuration that will mate with the center pin and outer shell of a BNC coaxial connector plug as if it were a BNC jack to provide a coaxial type unbalanced circuit connection, the same hybrid jack being adapted to mate with a special plug designed for said hybrid jack to provide a twisted pair type balanced circuit connection, the hybrid jack having a third contact for this purpose, said third jack contact comprising an additional barrel within and insulated from said outer barrel, said system further including switch means arranged for operation by and upon insertion of one of the plugs, to be operated between open and closed conditions by and upon insertion thereof.

2. A connector system comprising a socket member having first, second and third concentric contact elements, and a post member supporting said third contact element as a shell thereon, said system further including:

plug members of coaxial cable type and twin wire type, each proportioned to couple with said first and second contact elements, said plug members of said coaxial type including a dielectric member having a cup portion receiving said third contact of said socket member, but having no conductivity thereto when mated with said socket member, and said plug members of said twin wire type having a cup portion comprising a conductive element receiving the conductive shell of said post member of said socket member when mated with said socket member.

3. A connector system in accordance with claim 2, further including:

contactor means operable in a given state to effect connection between said second and thrid elements and in another state to not effect said connection, and said plug members of one type including a member having an extent axially of said plug member adapted to engage said contactor means to move the same from one state to the other, and said plug members of the other said type being proportioned to leave said contactor means in said one state.

4. A jack for mounting on a circuit board, said jack for receiving one of a first plug and a second plug, said first plug having one first plug conductor and a first plug ground, said second plug having a pair of second plug conductors and a second plug ground, said jack comprising:

a housing having a base and a barrel;

first and second jack conductors;

means for supporting said first and second jack conductors with respect to said housing, said supporting means supporting said first and second jack conductors at one end for protrusion from said base of said housing for mounting on said circuit board, said supporting means supporting said first and second jack conductors at a second end within said barrel, said supporting means including means for insulating said first and second jack conductors from one another; and means for maintaining ground continuity with one of said first plug ground and said second plug ground of said one of said first and second plugs when said one of said first and second plugs is received by said jack, said first conductor including means for switching between open and closed continuity positions with said ground continuity means, said switching means being closed when said first plug is received by said jack, said switching means being open when said second plug is received by said jack;

whereby said second jack conductor is in continuity with said one first plug conductor of said first plug and said first jack conductor is in continuity with said ground continuity means when said first plug is received by said jack and said first and second jack conductors of said jack are in continuity with said pair of second plug conductors of said second plug and said first jack conductor is disconnected from said ground continuity means when said second plug is received by said jack.

5. A jack in accordance with claim 4 wherein said barrel includes an arcuate inner wall, said first jack conductor includes a frame, and said switching means includes a first spring contactor depending from said frame, said first contactor including a first arcuate surface for disconnectably contacting the arcuate wall of said barrel.

6. A jack for mounting on a circuit board, said jack for receiving one of a first plug and a second plug, said first plug having a first plug conductor and a first plug ground member, said second plug having first and second plug conductors and a second plug ground member, said jack comprising:

a housing having a base and a barrel, said base including a shell having front, top and a pair of side walls, said barrel depending from the front wall, said barrel being conductive, said barrel including a generally cylindrical wall, said housing including first dielectric means between the walls of said shell and inside and outside a portion of the wall of said barrel;

a first jack conductor formed generally cylindrically from a sheet, said first jack conductor with a first lead extending from an end thereof and a first spring contactor depending therefrom, said first spring contactor being contactable with said barrel, said first spring contactor making no contact with said second plug when said second plug is received by said jack, said first spring contactor being spaced from said barrel and said first jack conductor making contact with said second plug conductor when said second plug is received by said jack;

a second jack conductor, said second jack conductor having a second frame with a second lead and a second contactor extending therefrom, said second contactor making contact with said first plug conductor when said first plug is received by said jack and making contact with said first second plug conductor when said second plug is received by said jack;

second dielectric means for insulating said first jack conductor from said second jack conductor, said second jack conductor being received by said second dielectric means, said second dielectric means being received by said first jack conductor, said first jack conductor being received by a cavity in said first dielectric means, and first and second leads passing outwardly from said jack; and means for grounding said barrel of said jack, said barrel being in contact with the first plug ground member when said first plug is received by said jack and in contact with said second plug ground member when said second plug is received by said jack.

7. A jack for mounting on a circuit board, said jack for receiving one of a first plug and a second plug, said first plug having one first plug conductor and a first plug ground, said second plug having a pair of second plug conductors and a second plug ground, said jack comprising:

a housing having a base and a barrel;

first and second jack conductors;

means for supporting said first and second jack conductors with respect to said housing, said supporting means supporting said first and second jack conductors at one end for protrusion from said base of said housing for mounting on said circuit board, said supporting means supporting said first and second jack conductors at a second end within said barrel, said supporting means including means for insulating said first and second jack conductors from one another; and means for maintaining ground continuity with one of said first plug ground and said second plug ground of said one of said first and second plugs when said one of said first and second plugs is received by said jack, said first conductor including means for switching between open and closed continuity positions with said ground continuity means, said switching means being closed when said first plug is received by said jack, said switching means being open when said second plug is received by said jack;

whereby said first jack conductor is in continuity with said one first plug conductor of said first plug and said second jack conductor is in continuity with said ground continuity means when said first plug is received by said jack and said first and second jack conductors of said jack are in continuity with said pair of second plug conductors of said second plug and said first jack conductor is disconnected from said ground continuity means when said second plug is received by said jack.

8. A jack for mounting on a circuit board, said jack for receiving one of a first plug and a second plug, said first plug having a first plug conductor and a first plug ground member, said second plug having first and second plug conductors and a second plug ground member, said jack comprising:

a housing having a base and a barrel, said base including a shell having front, top and a pair of side walls, said barrel depending from the front wall, said shell and said barrel being conductive, said barrel including a generally cylindrical wall, said housing including first dielectric means between the walls of said shell and inside and outside a portion of the wall of said barrel;

a first jack conductor formed generally cylindrically from a sheet, said first jack conductor including a first frame with a first lead extending from an end thereof and a first spring contactor depending from said frame, said first spring contactor being in contact with said barrel, said first spring contactor making no contact with said first plug when said first plug is received by said jack, said first spring contactor being spaced from said barrel and said first jack conductor making contact with said second plug conductor when said second plug is received by said jack;

a second jack conductor, said second jack conductor having a second frame with a second lead and a second contactor extending therefrom, said second contactor making contact with said first plug conductor when said first plug is received by said jack and making contact with said first second plug conductor when said second plug is received by said jack;

second dielectric means for insulating said first jack conductor from said second jack conductor, said second jack conductor being received by said second dielectric means, said second dielectric means being received by said first jack conductor, said first jack conductor being received by a cavity in said first dielectric means, said first and second leads passing through first and second passages in the back wall of said first dielectric means, said first and second leads being bent to extend downwardly approximately perpendicular to the axis of the wall of said barrel; and means for grounding the shell of said jack, said jack grounding means including a leg for mounting to said circuit board, said barrel being in contact with the first plug ground member when said first plug is received by said jack and in contact with said second plug ground member when said second plug is received by said jack.

9. A jack being suitable for receiving a first plug or a second plug, one of said plugs being a conventional coaxial cable plug having a first plug conductor and a first plug ground, and the other of said plugs being a wire pair cable plug having a pair of second plug conductors and a second plug ground, said jack comprising:

a barrel;

first and second jack conductors within said barrel; and means for maintaining ground continuity with either of said first plug ground or said second plug ground, said first jack conductor including means for switching between open and closed continuity positions with said ground continuity means, said switching means being closed when one plug is received by said jack, said switching means being open when the other plug is received by said jack;

whereby said second jack conductor is in continuity with said first plug conductor and said ground continuity means when one plug is received by said jack; and whereby said first and second jack conductors are in continuity with said pair of second plug conductors with said first jack conductor being disconnected from said ground continuity means when said other plug is received by said jack.

10. A connector plug and socket system comprising a first connector means having first, second and third concentrically oriented radially distributed contact elements, and including:

normally open contactor means operable in a closed switch state to effect connection between said second and third elements and in an open switch state to not effect said connection, and second connector members of one configuration and a second configuration, each proportioned to couple with said first and second contact elements, said second connector members of said one configuration including a part having an extent axially of said second connector member adapted to engage said contactor means to operate the same in a closed switch condition, and said second connector members of said second configuration being configured to leave said contactor means in said open switch condition, said part comprises electrical contact means moved into engagement with said contactor means by and upon engagement of said second connector member with said first connector member, said second connector member of said second configuration comprises dielectric material moved into engagement with said contactor means by and upon engagement of said second connector member of said second configuration with said first connector member.

11. A connector plug and socket system comprising a first connector means having first, second and third concentrically oriented radially distributed contact elements, and including:

normally open contactor means operable in a closed switch state to effect connection between said second and third elements and in an open switch state to not effect said connection, and second connector members of one configuration and a second configuration, each proportioned to couple with said first and second contact elements, said second connector members of said one configuration including a part having an extent axially of said second connector member adapted to engage said contactor means to operate the same in a closed switch condition, and said second connector members of said second configuration being configured to leave said contactor means in said open switch condition, said part comprises electrical contact means moved into engagement with said contactor means by and upon engagement of said second connector member with said first connector member, said second connector member of said second configuration comprises dielectric material moved into engagement with said contactor means by and upon engagement of said second connector member of said second configuration with said first connector member.

12. A jack for receiving one of a first plug and a second plug, said first plug having one first plug conductor and a first plug ground, said second plug having a pair of second plug conductors and a second plug ground, said jack comprising:

a housing having a base and a barrel;

first and second jack conductors;

means for supporting said first and second jack conductors with respect to said housing, said supporting means supporting said first and second jack conductors within said barrel and said base of said housing, said supporting means including means for insulating said first and second jack conductors from one another;

means for maintaining ground continuity with one of said first plug ground and said second plug ground of said one of said first and second plugs when said one of said first and second plugs is received by said jack, said first jack conductor including means for switching between open and closed continuity positions with said ground continuity means, said switching means being closed when said first plug is received by said jack, said switching means being open when said second plug is received by said jack;

whereby said second jack conductor is in continuity with said one first plug conductor of said first plug and said first jack conductor is in continuity with said ground continuity means when said first plug is received by said jack and said first and second jack conductors of said jack are in continuity with said pair of second plug conductors of said second plug and said first jack conductor is disconnected from said ground continuity means when said second plug is received by said jack.

* * * * *